US011517082B2

(12) United States Patent
Schlichtig et al.

(10) Patent No.: US 11,517,082 B2
(45) Date of Patent: Dec. 6, 2022

(54) CASE MIDDLE/HORN CONNECTION DEVICE FOR A WATCH

(71) Applicant: ETA SA Manufacture Horlogere Suisse, Grenchen (CH)

(72) Inventors: Dohan Schlichtig, Olten (CH); Jerome Grosjean, Orvin (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 224 days.

(21) Appl. No.: 16/991,100

(22) Filed: Aug. 12, 2020

(65) Prior Publication Data

US 2021/0085041 A1 Mar. 25, 2021

(30) Foreign Application Priority Data

Sep. 24, 2019 (EP) ..... 19199353

(51) Int. Cl.
*A44C 5/14* (2006.01)
*G04B 37/00* (2006.01)

(52) U.S. Cl.
CPC ..... *A44C 5/147* (2013.01); *G04B 37/0008* (2013.01)

(58) Field of Classification Search
CPC ..... G04B 37/22; G04B 37/0008; G04B 37/1486; G04B 37/1493; G04B 37/16; A44C 5/147; A44C 5/2052; A44C 5/10
See application file for complete search history.

(56) References Cited

U.S. PATENT DOCUMENTS 3,165,884 A 1/1965 Gwinner et al.
4,414,719 A 11/1983 Capolupo
6,168,055 B1 1/2001 Grados
(Continued)

FOREIGN PATENT DOCUMENTS

CH 418 985 A 4/1966
CN 1985697 A 6/2007
(Continued)

OTHER PUBLICATIONS

Combined Chinese Office Action and Search Report dated Jul. 28, 2021 in Chinese Patent Application No. 202011018185.0 (with English translation of Categories of Cited Documents), 9 pages.
(Continued)

*Primary Examiner* — Edwin A. Leon
(74) *Attorney, Agent, or Firm* — Oblon, McClelland, Maier & Neustadt, L.L.P.

(57) ABSTRACT

A case middle/horn connection device for a watch, a method for attaching an attachment piece including at least one horn to a case middle and a case middle/horn assembly. The connection device includes an attachment piece including at least one horn having a first connector and a case middle having a second connector, the first connector being configured to cooperate with the second connector to attach the attachment piece to the case middle. The first connector includes a tongue with a recess. The second connector includes a groove with an undercut portion. The undercut portion is configured to lodge inside the recess of the tongue; and the case middle and the attachment are made integral when the undercut portion of the second connector is lodged in the recess of the tongue of the first connector.

12 Claims, 4 Drawing Sheets

(56) References Cited

U.S. PATENT DOCUMENTS

| | | | | |
|---|---|---|---|---|
| 8,790,004 | B2 * | 7/2014 | Chatelain | G04B 37/0008 368/282 |
| 9,977,403 | B2 * | 5/2018 | Leoni | G04B 45/0076 |
| 10,993,512 | B2 * | 5/2021 | Rochat | G04B 37/1493 |
| 11,022,943 | B2 * | 6/2021 | Romano | A44C 5/14 |
| 2010/0302913 | A1 | 12/2010 | Loiseau | |
| 2018/0271231 | A1 | 9/2018 | Zeng et al. | |

FOREIGN PATENT DOCUMENTS

| | | | |
|---|---|---|---|
| CN | 107581725 | A | 1/2018 |
| CN | 108143056 | A | 6/2018 |
| CN | 109674154 | A | 4/2019 |
| CN | 209103107 | U | 7/2019 |
| EP | 0 466 655 | A1 | 1/1992 |
| FR | 3 021 128 | A1 | 11/2015 |
| GB | 933969 | A | 8/1963 |
| JP | 63-63406 | A | 3/1988 |
| WO | WO 97/46922 | A1 | 12/1997 |
| WO | WO 2009/030984 | A1 | 3/2009 |
| WO | 2011/045239 | A1 | 4/2011 |
| WO | 2017/195054 | A1 | 11/2017 |
| WO | 2018/024120 | A1 | 2/2018 |

OTHER PUBLICATIONS

Office Action dated Dec. 1, 2021 in corresponding Indian Patent Application No. 202044041087 (with English Translation), 5 pages.

European Search Report dated Mar. 9, 2020 in European Application 19199353.4 filed Sep. 24, 2019 (with English Translation of Categories of Cited Documents), 3 pages.

Office Action dated Sep. 14, 2021 in corresponding Japanese Patent Application No. 2020-140594 (with English Translation), 6 pages.

* cited by examiner

CASE MIDDLE/HORN CONNECTION DEVICE FOR A WATCH

CROSS-REFERENCE TO RELATED APPLICATION

This application claims priority to European Patent Application No. 19199353.4 filed on Sep. 24, 2019, the entire disclosure of which is hereby incorporated herein by reference.

FIELD OF THE INVENTION

Generally, the invention concerns a method for attaching a horn to a watch case middle, a case middle/horn connection device and a case middle/horn assembly.

BACKGROUND OF THE INVENTION

Swiss Patent No. CH 708815 concerns an exterior element for a wristwatch case middle. The exterior element for a wristwatch case middle takes the form of a separate cover plate which is attached to the wristwatch case middle and at least partially covers an area of connection between a bracelet strand and the watch case middle.

European Patent No. EP 0466655 concerns a watch case and a device for attaching a bracelet to the watch case. The watch case middle comprises one or two recesses arranged to receive the end of each bracelet strand. The ends of the bracelet are retained by attachment means consisting of claws or hollows, corresponding to notches or protuberances provided in proximity to the ends of the bracelet strands, and which are arranged on extensions of the watch case back or on intermediate pieces secured to the back cover or middle part of the case.

European Patent No. EP 0197416 concerns an assembly consisting of a watch case element and a bracelet having at least one strand. The strand is made of a first thermoplastic plastic material. The case element is made of a second thermoplastic plastic material having a higher melting temperature than the melting temperature of the first plastic material. The case element comprises a portion surrounding at least one end of the strand and integral with this end.

GENERAL DESCRIPTION OF THE INVENTION

A first aspect of the invention concerns a case middle/attachment piece (hereinafter 'case middle/horn') connection device for a watch, comprising an attachment piece with at least one horn having a first connector, and a case middle having a second connector, the first connector being configured to cooperate with the second connector to attach the horn to the case middle, wherein:

- the first connector comprises a tongue with a recess;
- the second connector comprises a groove with an undercut portion, the undercut portion being configured to lodge inside the recess of the tongue; and
- the case middle and the horn are configured to be made integral when the undercut portion of the second connector is lodged inside the recess of the tongue of the first connector.

A 'groove with an undercut portion' means a groove whose shape prevents the direct release of solid material which even partially fills the undercut portion thereof.

The 'case middle and attachment piece are configured to be made integral' means that the attachment piece is configured to be reversibly or irreversibly joined, through contact, to the case middle. Preferably, the joint or bond is irreversible. An 'irreversible joint' means any joint that requires the destruction of the structure of the connectors in order to separate the case middle from the attachment piece.

It will be appreciated that such a device makes it easy to connect a case middle and an attachment piece comprising at least one watch horn. Indeed, it is sufficient to apply compression between the case middle and the attachment piece for the undercut portion of the second connector to lodge inside the recess of the tongue of the first connector. In this manner, and owing to the undercut portion, removal by a force opposite to compression is impossible: the attachment piece and the case middle are integral.

According to a preferred embodiment, the tongue is configured to deform elastically when inserted into the groove, the tongue and the undercut portion being configured such that the tongue returns substantially to its rest position, preferably returns to its rest position, when the undercut portion lodges inside the tongue recess.

Preferably, the groove extends over a length L. Length L can be in the range from 10% to 90%, preferably in the range from 40% to 80%, more preferably in the range from 50% to 70%, most preferably in the range from 60% to 70% of the length over which the tongue is configured to deform elastically when inserted into the groove[1]. It will be appreciated that, in this manner, the two connectors are firmly joined. Moreover, this configuration mitigates the risk of detachment and/or damage of the connectors when a moment of force is applied to one and/or the other of the two connectors. ≠[1]May need to be modified depending on the application.

The groove can comprise an undercut portion on which the tongue is configured to bend elastically when the tongue is inserted into the groove. In this manner, the elastic deformation (i.e. the elastic bending) of the tongue is forced and accompanied by the undercut portion until the moment when the undercut portion of the second connector lodges in the recess of the tongue of the first connector.

Preferably, the recess is a through recess.

According to one embodiment, the first connector comprises a tenon and the second connector comprises a mortise. The mortise is configured to guide the tenon when the first connector of the horn is placed in contact with the second connector of the case middle. According to a preferred embodiment, the first connector comprises two or more tenons and the second connector comprises two or more mortises. The mortises are configured to guide the tenons when the first connector of the horn is placed in contact with the second connector of the case middle. It will be appreciated that the presence of one or more tenons and one or more mortises allows the guided insertion of the first connector into the second connector. The presence of several mortises and tenons mitigates the risk of improper insertion when, e.g. a force couple is applied to the first and/or second connectors.

The second connector preferably comprises one or more support parts for the tongue of the first connector in order to limit the elastic deformations of the tongue when the undercut portion is lodged in the tongue recess. The one or more support parts can, limit, for example sterically (i.e. geometrically) the elastic deformations of the tongue.

The tongue is preferably made of steel.

The rest of the attachment piece (other than the tongue) is preferably made of a different material from the tongue. According to one embodiment, the rest of the attachment piece is moulded around the tongue, with the tongue protruding from the attachment piece. The moulding is preferably made from a plastic material. The edges of the tongue can be enclosed in the moulding of the rest of the attachment piece.

The second connector can be machined, the case middle is preferably machined. The case middle is preferably made of steel.

A second aspect of the invention concerns an attachment method comprising a case middle/horn connection device according to the first aspect of the invention. The method includes the insertion of the first connector of the attachment piece into the second connector of the case middle such that the undercut portion lodges in the tongue recess.

A third aspect of the invention concerns a case middle/horn assembly obtained from the attachment method according to the second aspect of the invention.

BRIEF DESCRIPTION OF THE DRAWINGS

Other peculiarities and features of the invention will appear from the detailed description of certain advantageous embodiments presented below, by way of illustration, with reference to the annexed drawings which show.

The reader's attention is drawn to the fact that the drawings are not to scale. Further, for reasons of clarity, the proportions of height, length and/or width may not be correctly represented. Finally, and in particular, the spaces or recesses between the connectors when placed in contact may be greater or smaller than in a real implementation of the invention.

DETAILED DESCRIPTION OF ONE EMBODIMENT OF THE INVENTION

Figure 1:
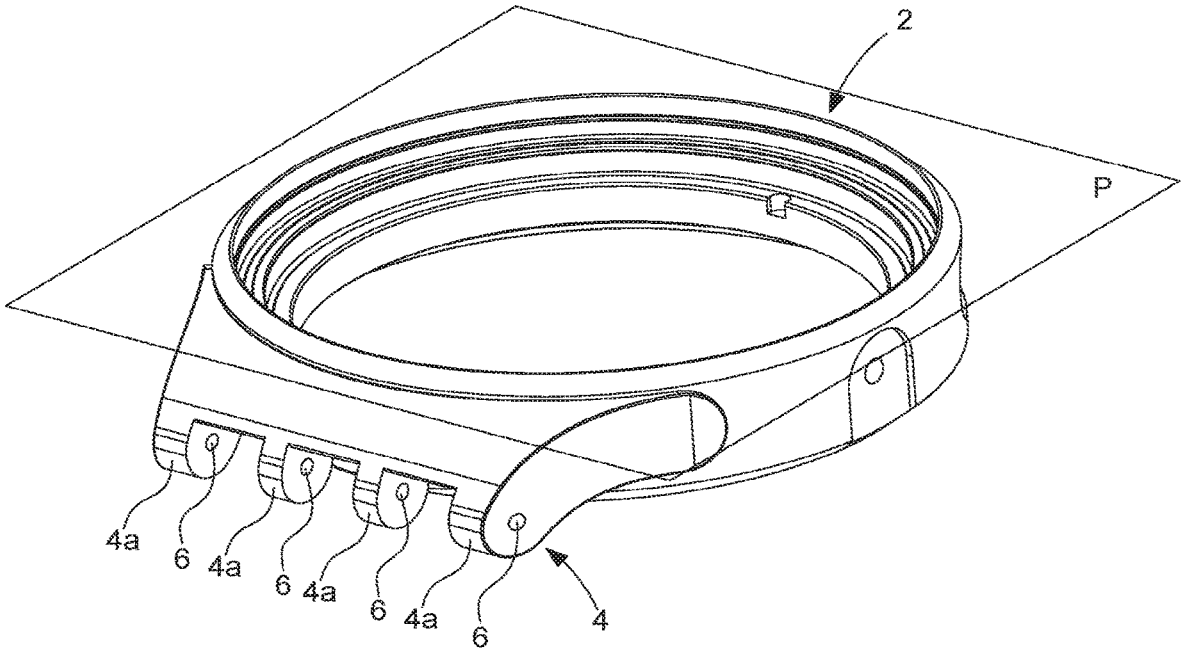
FIG. 1: a perspective view of a case middle/horn assembly according to one embodiment of the invention.
Figure 2:
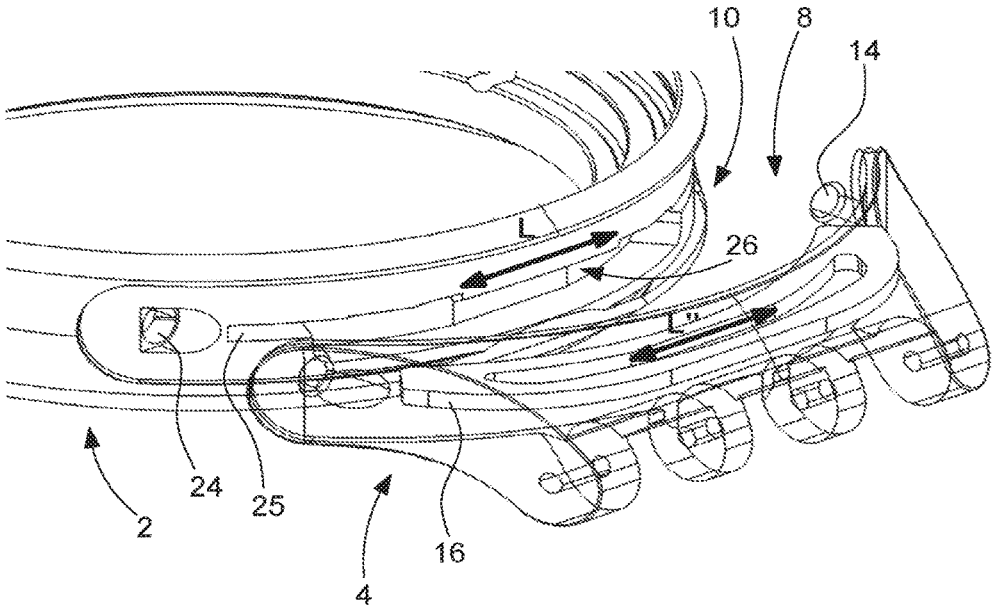
FIG. 2: a perspective view of a case middle and of an attachment piece according to one embodiment of the invention.
Figure 3:
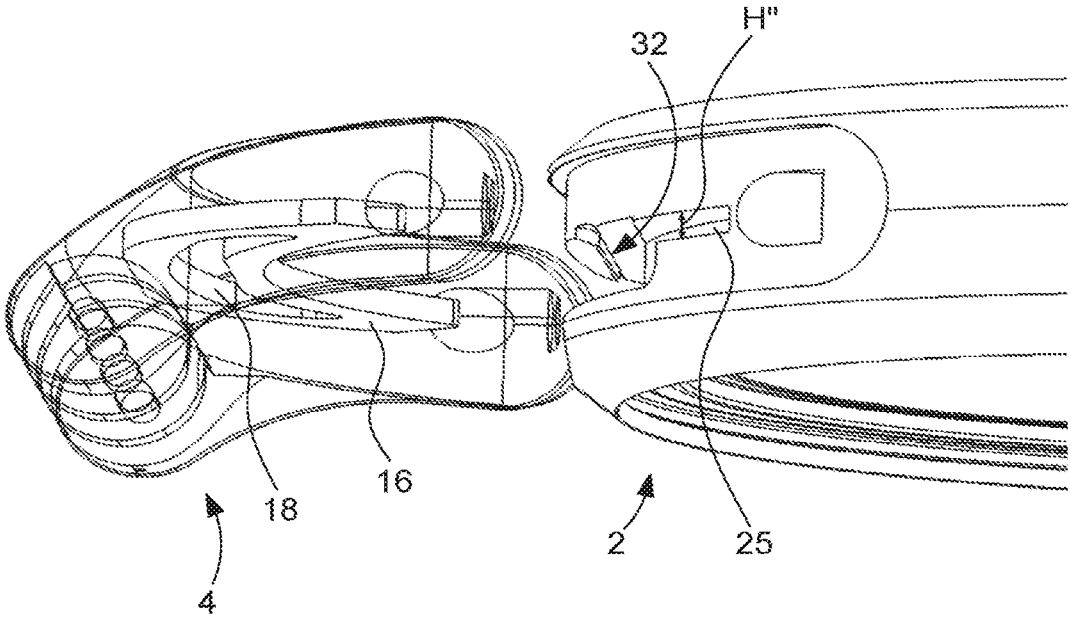
FIG. 3: a perspective view of a case middle and of an attachment piece according to one embodiment of the invention.
Figure 4:
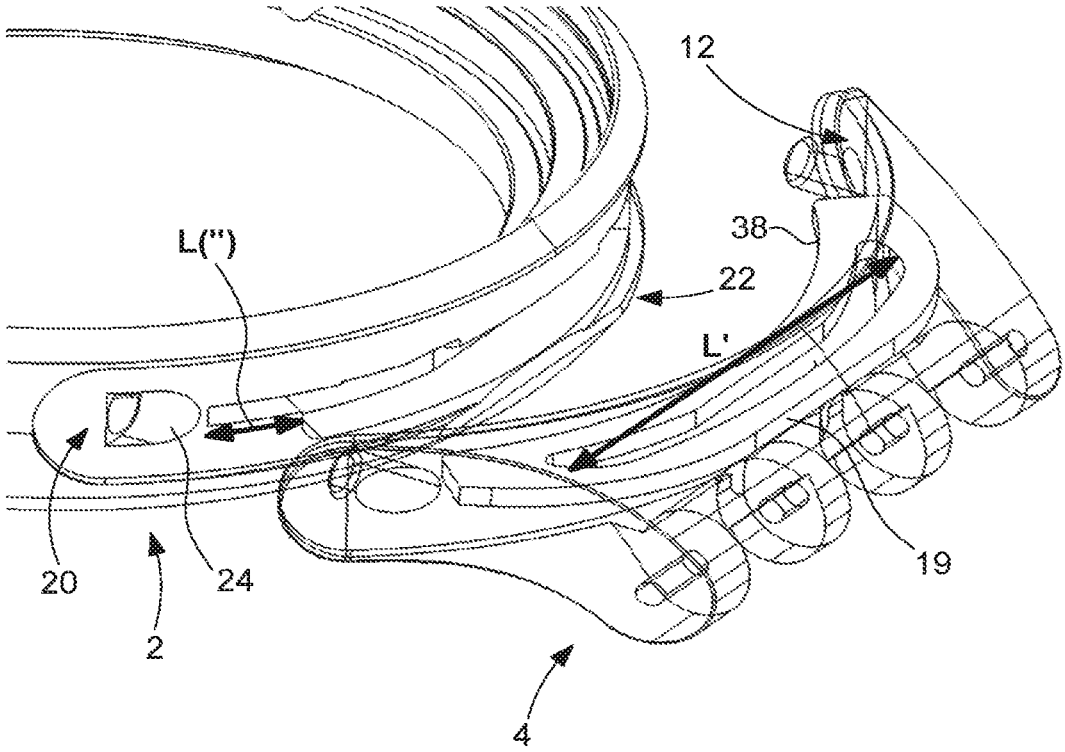
FIG. 4: a perspective view of a case middle and of an attachment piece according to one embodiment of the invention.
Figure 5:
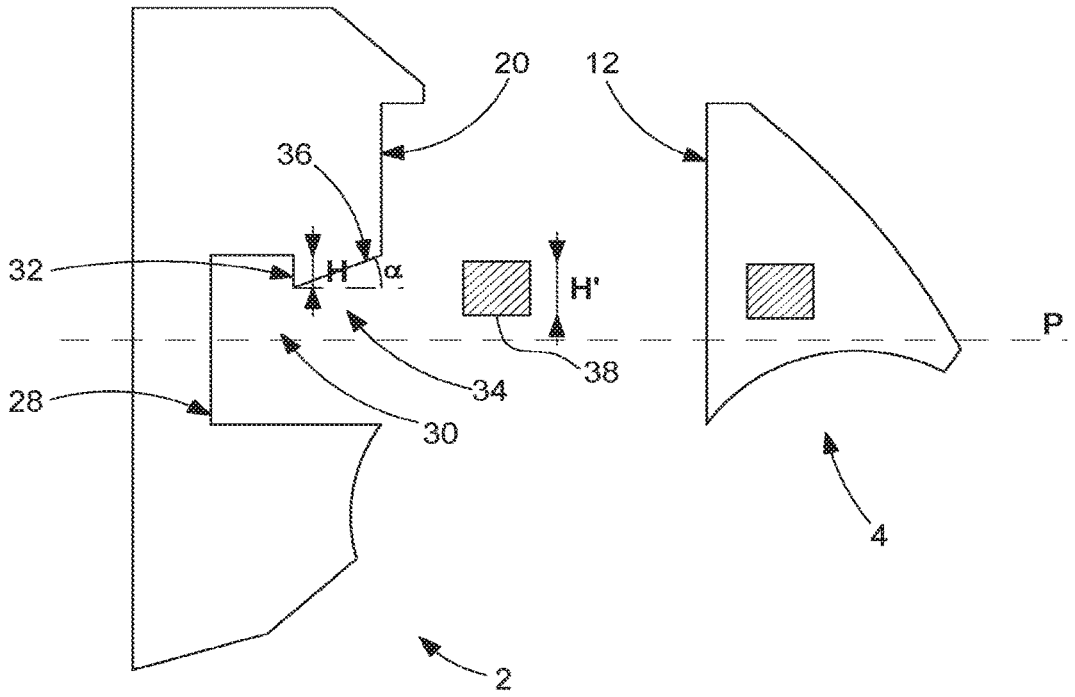
FIG. 5: a cross-section of a case middle and of an attachment piece according to one embodiment of the invention.

With reference to FIG. 1, an assembly of a case middle 2/attachment piece with at least one horn 4 (hereinafter the 'case middle/horn assembly') is described according to one embodiment of the invention. Case middle 2 is an element of a watch case (partially represented) used to protect the watch movement, e.g. from dust, moisture, shocks, etc. . . . It is the median portion of the watch case which accommodates the watch movement. According to the embodiment described, case middle 2 is circular. However, other shapes are suitable, such as, e.g. a square shape, a rectangular shape, an ellipsoidal shape, etc. . . . Case middle 2 defines a main plane P located at mid-height of the latter.

The attachment piece with at least one horn 4 allows a bracelet to be attached to case middle 2. In the embodiment illustrated in FIG. 1, attachment piece 4 comprises four horns 4*a* each provided with holes 6 aligned transversely to the longitudinal direction of a bracelet (not represented), horns 4*a* being arranged to attach the bracelet by means, for example, of a pin passing through holes 6. It is evident that other means of attaching the bracelet to the attachment piece are suitable. Moreover, the shape, length and width and the number of horns 4*a* may vary depending on the type of watch.

FIGS. 2-5 show attachment piece 4 and case middle 2 when they are not joined, according to a preferred embodiment of the invention. Attachment piece 4 includes a first connector 8 and case middle 2 comprises a second connector 10. First connector 8 is configured to cooperate with second connector 10 to attach attachment piece 4 to case middle 2.

First connector 8 has a circular inner surface 12, perpendicular to main plane P, configured to be in direct contact with case middle 2 when case middle 2 and horn 4 are joined. First connector 8 comprises two tenons 14 and a tongue 16, all protruding from the circular inner surface 10 inwards (i.e. towards case middle 2).

Generally, the length of an element (e.g. of the tongue, of the through recess) is defined as being the (Euclidean) distance between the two points furthest from the element in a plane collinear to plane P.

Steel tongue 16 comprises a through recess 18 over a length L' of tongue 16. Length L' is comprised in a range from 70% to 95%, preferably from 70% to 90%, more preferably from 70% to 80% of the length of tongue 16.

The rest of attachment piece 4 (i.e. other than the tongue) is moulded around tongue 16. In this manner, tongue 16 is made integral with the rest of attachment piece 4. The rest of attachment piece 4 is made of plastic material.

More particularly, tongue 16 has two curved edges which join at their ends. The overmoulding is carried out in such a way that the radially outermost edge is enclosed in the moulding and the radially innermost edge is free and protrudes inwards. The free space remaining between the two edges after overmoulding corresponds to through recess 18. It will be appreciated that other techniques can be used to enclose tongue 16 in the rest of attachment piece 4.

The radially innermost edge 38 of attachment piece 4, protruding inwards, comprises a planar radially outer abutment surface 19. Planar surface 19 is perpendicular to plane P and extends over a length L" comprised in the range from 20% to 80%, preferably 30% to 70%, more preferably 25% to 40% of the length of tongue 16.

The state (and position) of tongue 16 represented in FIGS. 2-5 is the rest state (and position) of the latter.

Tenons 14 are arranged symmetrically on both sides of attachment piece 4 and are cylindrical in shape, the base of the cylinder being perpendicular to main plane P. According to other embodiments, tenons 14 can have other shapes, e.g. parallelepiped, conical, etc. . . .

Case middle 2 includes a second connector 10 configured to cooperate with first connector 8 of attachment piece 4 in order to attach attachment piece 4 to case middle 2. In particular, the second connector has an oblong curved surface 20 set back radially from the radially outer surface of case middle 2. Oblong curved surface 20 is configured to be placed in direct contact with the inner circular surface 12 of attachment piece 4. Second connector 10 comprises a groove 22, two mortises 24 and two support parts 25 for the tongue, all forming a depression with respect to oblong curved surface 20.

The groove includes an undercut portion 26. Undercut portion 26 extends over a length L. Length L can be substantially equal to length L" of planar surface 19. The ratio between length L and length L" is comprised in a range from 0.7 to 1.3, preferably in a range from 0.8 to 1.2 and more preferably in a range from 0.95 to 1.15.

Undercut portion 26 includes a radially inner planar abutment surface 28, substantially perpendicular to plane P, preferably with a re-entrant angle on the order of 5°. Further, undercut portion 26 also includes a recess 30 delimited by the radially inner planar abutment surface 28 and a radially outer planar abutment surface 32. Radially outer planar abutment surface 32 is perpendicular to plane P. The ratio between height H of the radially outer surface 32 and the tongue height H' is comprised between 0.3 and 1.5, preferably between 0.35 and 0.5.

Further, the groove includes an undercut portion 34 having a planar undercut surface 36. The planar undercut surface forms an angle $\alpha$ relative to plane P. Angle $\alpha$ is comprised in a range from 10° to 45°, preferably from 15° to 40°, more preferably from 20° to 35°.

The groove also includes two support parts 25 for the tongue. The two support parts 25 are arranged laterally and symmetrically, at the edges of the groove. The ratio between the height H" of support parts 25 and the tongue height H' is comprised in a range from 0.8 to 1.5 and preferably from 1 to 1.15. Further, the length $L^{(4)}$ of each support part 25 is comprised in the range from 2.5% to 20%, preferably from 5% to 15%, more preferably from 7% to 13% of the length of the tongue.

Mortises 24 are arranged symmetrically on either side of second connector 10 (laterally substantially at the edges of second connector 10). Mortises 26 have a cylindrical shape with the base of the cylinder perpendicular to main plane P. According to other embodiments, mortises 26 can have other shapes, e.g. parallelepiped, conical, etc. . . .

Figure 6:
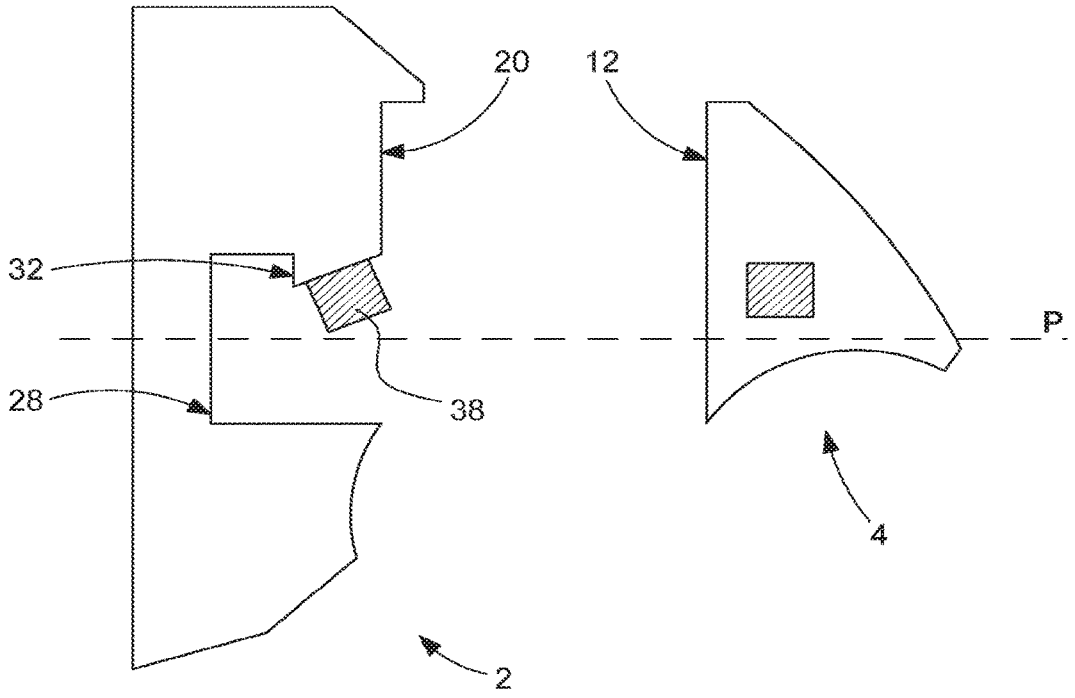
FIG. 6: a cross-section of a case middle and of an attachment piece during insertion of the horn into the case middle according to one embodiment of the invention.

FIG. 6 is a sectional view showing the insertion of attachment piece 4 into case middle 2 when these latter elements start to engage. The protruding edge 38 deforms elastically on contact with the planar undercut surface 36. More particularly, protruding edge 38 is bent by planar undercut surface 36. The rest of the case middle and the ends of edge 38 are held in place by support parts 25 and tenons 14 lodged inside mortises 24 (not represented—see e.g. FIGS. 1-5). In this context, it is to be noted that tenons 14 and tongue 16 come into contact with mortises 24 and parts 25, 34, respectively at (substantially) the same time. It follows that the mortises and support parts guide the tenons and the ends of the protruding edge when the first connector of the horn is placed in contact with the second connector.

Figure 7:
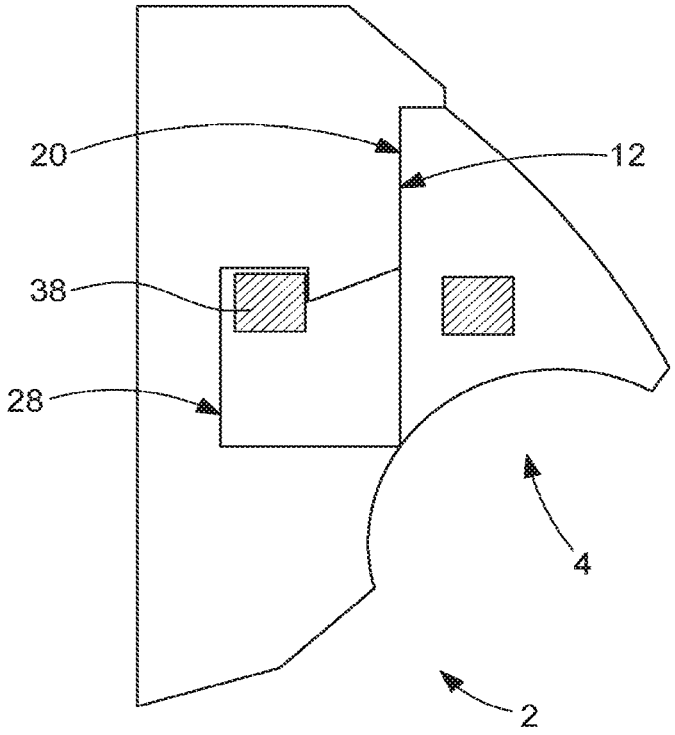
FIG. 7: a cross-section of a case middle/horn assembly according to one embodiment of the invention.

FIG. 7 is a sectional view shown the insertion of attachment piece 4 into case middle 2 when these latter elements are integrally engaged. The edge has returned to its rest position by insertion into recess 30 of undercut portion 26. This insertion occurred when the edge passed over undercut portion 36 (in particular when planar radially outer abutment surface 19 passed over radially external flat stop surface 32 of undercut portion 26). According to another embodiment, the edge may only substantially return to its rest position. This may be the case, for example, when the recess is not a through recess and the undercut portion does not allow the edge to return to its rest position.

Radially outer planar abutment surface 32 of undercut portion 26 is in direct contact with radially outer planar abutment surface 19 of protruding edge 38. Case middle 2 and attachment piece 4 are thus made integral and form a case middle/horn assembly. In fact, the application of an opposite force to that applied to insert attachment piece 4 into case middle 2 cannot separate these latter elements.

Further, inner circular surface 12 of the attachment piece and oblong curved surface 20 of case middle 2 are in direct contact, if necessary with a clearance on the order of 1/10 mm when the case middle and the attachment piece are joined.

As the ratio between height H" of support parts 25 and tongue height H' is substantially the same, any elastic deformations of protruding edge 38 are significantly reduced compared to possible deformations when the protruding edge is not inserted into connector 10 of case middle 2. Indeed, support parts 25 sterically limit the elastic deformation of edge 38, particularly in the event of force applied to the attachment piece in a direction perpendicular to the dial. Consequently, it is much more difficult to remove the attachment piece from the case middle than to attach them to each other.

Although particular embodiments have just been described in detail, those skilled in the art will appreciate that various modifications and alternatives thereto could be developed in light of the overall teaching provided by the present disclosure of the invention. Consequently, the specific arrangements and/or methods described herein are intended to be given purely by way of illustration, with no intention of limiting the scope of the invention.

The invention claimed is:

1. A case middle/attachment piece connection device for a watch, comprising:

an attachment piece having a first connector; and a case middle having a second connector, the first connector being configured to cooperate with the second connector to attach the attachment piece to the case middle, wherein:

the first connector comprises a tongue with a recess, the second connector comprises a groove with an undercut portion, the undercut portion being configured to lodge inside the recess of the tongue, the case middle and the attachment piece are configured to be made integral when the undercut portion of the second connector is lodged inside the recess of the tongue of the first connector, and wherein the case middle and the attachment piece are irreversibly joined to each other.

2. The case middle/attachment piece connection device claimed in claim 1, wherein the tongue has a rest position, and wherein the tongue is configured to deform elastically when inserted into the groove, the tongue and the undercut portion being configured such that the tongue returns to its rest position when the undercut portion lodges in the recess of the tongue.

3. The case middle/attachment piece connection device claimed in claim 2, wherein the groove also comprises an undercut portion on which the tongue is configured to bend elastically when the tongue is inserted into the groove.

4. The case middle/attachment piece connection device according to claim 1, wherein the recess is a through recess.

5. The case middle/attachment piece connection device according to claim 1, wherein the case middle and the attachment piece are irreversibly joined to each other.

6. The case middle/attachment piece connection device according to claim 1, wherein the first connector comprises a tenon and the second connector comprises a mortise, the mortise being configured to guide the tenon when the first connector of the attachment piece is placed in contact with the second connector of the case middle.

7. The case middle/attachment piece connection device according to claim 6, wherein the first connector comprises two or more tenons and the second connector comprises two or more mortises, the mortises being configured to guide the tenons when the first connector of the attachment piece is placed in contact with the second connector of the case middle.

8. The case middle/attachment piece connection device according to claim 1, wherein the second connector comprises one or more support parts for the tongue of the first connector in order to limit the elastic deformations of the tongue when the undercut portion is lodged in the tongue recess.

9. The case middle/attachment piece connection device according to claim 1, wherein the tongue is made of steel.

10. The case middle/attachment piece connection device according to claim 1, wherein the attachment piece is moulded around the tongue, the moulding being made from a plastic material.

11. The case middle/attachment piece connection device according to claim 1, wherein the case middle is machined, and the second connector is machined.

12. A method of attachment of a case middle and an attachment piece with the case middle/attachment piece connection device according to claim 1, the method comprising:

insertion of the first connector of the attachment piece into the second connector of the case middle such that the undercut portion lodges inside the recess of the tongue.

* * * * *